United States Patent [19]

Warshawsky

[11] 4,260,369

[45] Apr. 7, 1981

[54] METHOD OF CONVERTING A ROTARY KILN CEMENT MAKING PLANT TO A CALCINING FURNACE CEMENT MAKING PLANT

[75] Inventor: Jay Warshawsky, Allentown, Pa.

[73] Assignee: Fuller Company, Bethlehem, Pa.

[21] Appl. No.: 95,262

[22] Filed: Nov. 19, 1979

[51] Int. Cl.[3] ..... F27D 1/16

[52] U.S. Cl. ..... 432/3; 106/100; 432/106

[58] Field of Search ..... 432/3, 14, 106; 106/100

[56] References Cited

U.S. PATENT DOCUMENTS

| | | | |
|---|---|---|---|
| 2,758,828 | 8/1956 | Pyzel | 106/100 |
| 3,865,541 | 2/1975 | Wilson et al. | 432/106 |
| 4,105,396 | 8/1978 | Ritzmann | 432/106 |

*Primary Examiner*—John J. Camby

*Attorney, Agent, or Firm*—Frank H. Thomson

[57] ABSTRACT

A method for converting existing long rotary kiln wet or dry process cement making plants to a more energy efficient operation including removing a central section of an existing rotary kiln and replacing it with a furnace and associated material separator for calcining material received from a first beginning section of the existing kiln which functions as a preheater and for supplying the calcined material to an end portion of the existing kiln which serves as a clinkering device.

6 Claims, 2 Drawing Figures

METHOD OF CONVERTING A ROTARY KILN CEMENT MAKING PLANT TO A CALCINING FURNACE CEMENT MAKING PLANT

BACKGROUND OF THE INVENTION

The present invention relates to a method of converting existing long wet or dry process rotary kiln cement making plants to more energy efficient calcining furnace cement making plants.

In order to manufacture Portland cement, it is generally known that raw material comprising primarily limestone and clay and commonly called meal must first be heated to calcining temperature and then further heated to clinkering temperature to carry out the chemical reactions necessary to turn the meal into cement clinker. Many existing cement plants utilize a long rotary kiln in either a wet process or dry process for carrying out both the calcining and clinkering operations.

It is known to use some form of preheater which utilizes waste heat from the rotary kiln to preheat the raw meal prior to its introduction to the rotary kiln. The use of such a preheater serves to lower fuel consumption and normally allows a reduction in the length of the rotary calcining and clinkering kiln for a given cement making capacity. Typically, a suspension type preheater is used having a plurality of serially connected cyclone separators which provide for raw meal to be alternately introduced into and separated from the flow of hot waste gases from the kiln to thereby preheat the raw meal. Such an apparatus is illustrated in U.S. Pat. No. 2,648,532.

While the combination of a multi-stage suspension preheater with a rotary kiln achieves a higher throughput and lowered overall energy consumption for a cement plant, the multi-stage suspension preheater results in a large pressure drop as heated gases pass through it, causing a large consumption of energy for preheating raw meal. The multi-stage suspension preheater is also formed by several interconnected cyclone separators which are expensive in terms of equipment and installation costs.

A more recent innovation in the cement making process is to utilize a separate, stationary calcining furnace interposed between the suspension preheater and the rotary kiln. U.S. Pat. No. 3,891,382 is typical of such an apparatus. With such an apparatus, the raw meal is preheated in a suspension preheater and substantially completely calcined in suspension in the flash furnace. From the flash furnace, the calcined material is supplied to a rotary kiln where final clinkering takes place. By separating the preheating, calcining and clinkering functions, the quantity of cement clinker which can be produced in a given size rotary kiln can be doubled when compared with a suspension preheater—rotary kiln installation and even more when compared with a long dry or long wet process kiln. In addition, substantial fuel savings can be achieved when compared with long dry or long wet process kilns.

In view of the improved capacity and efficiency of modern plants employing separate preheating, calcining and clinkering stages, it is desirable to modernize older plants which utilize the long dry or wet process of manufacturing cement clinker.

Older long wet or dry process rotary kiln cement making plants can be converted to more efficient cement plant operations by shortening the conventional rotary kiln and utilizing the multi-stage suspension preheater and calcining furnace combination as an input to the remaining portion of the rotary kiln. This technique is described in the article "Conversion of Existing Cement Kilns to Flash Calciners" by J. Warshawsky appearing in IEEE Transactions on Industry Applications, Vol. 1A-12, No. 6, November/December 1976. While the throughput and energy efficiency of such a plant is increased, the large pressure drop associated with the suspension preheater remains and there may be an associated equipment loss if the removed section of the long rotary kiln cannot be used for other purposes and is discarded. In addition, the large capital expense and installation cost associated with the multi-stage suspension preheater remains.

The present invention is a method of converting an existing long rotary kiln cement plant to a higher throughput, more energy efficient calcining furnace plant which overcomes the noted problems associated with use of the multi-stage suspension preheater.

The invention employs the concept of using a section of a rotary kiln as a preheater which feeds preheated raw material to a calcining furnace which in turn is connected to the input of a rotary kiln clinkering device, the output of which is further fed to a clinker cooler. The rotary preheater has a much lower pressure drop associated therewith and efficiently promotes heat exchange through internal lifters and chains to preheat the raw meal. The rotary preheater also has lower equipment and installation costs associated therewith as compared with multi-stage suspension preheaters. The use of a rotary preheater is particularly advantageous in the conversion of an existing long dry or wet process rotary kiln cement-making plant, as a center section of an existing long kiln can be cut and removed leaving a beginning portion of the kiln for use as the rotary preheater. The output of the rotary preheater is connected to a newly installed calcining furnace and an associated material separator. The remaining end portion of the existing kiln is connected to the output of the calcining furnace and the associated material separator for use as a clinkering kiln. The conversion of an existing kiln achieves the desirable objectives of a reduced energy consumption and increased throughput, while retaining use of a major portion of the original equipment.

These and other objects and advantages of the invention will become more apparent in the subsequent detailed description of the invention.

BRIEF DESCRIPTION OF THE DRAWINGS

The detailed description of the invention will be presented in connection with the accompanying drawings in which.

DETAILED DESCRIPTION OF THE DRAWINGS

Figure 1:
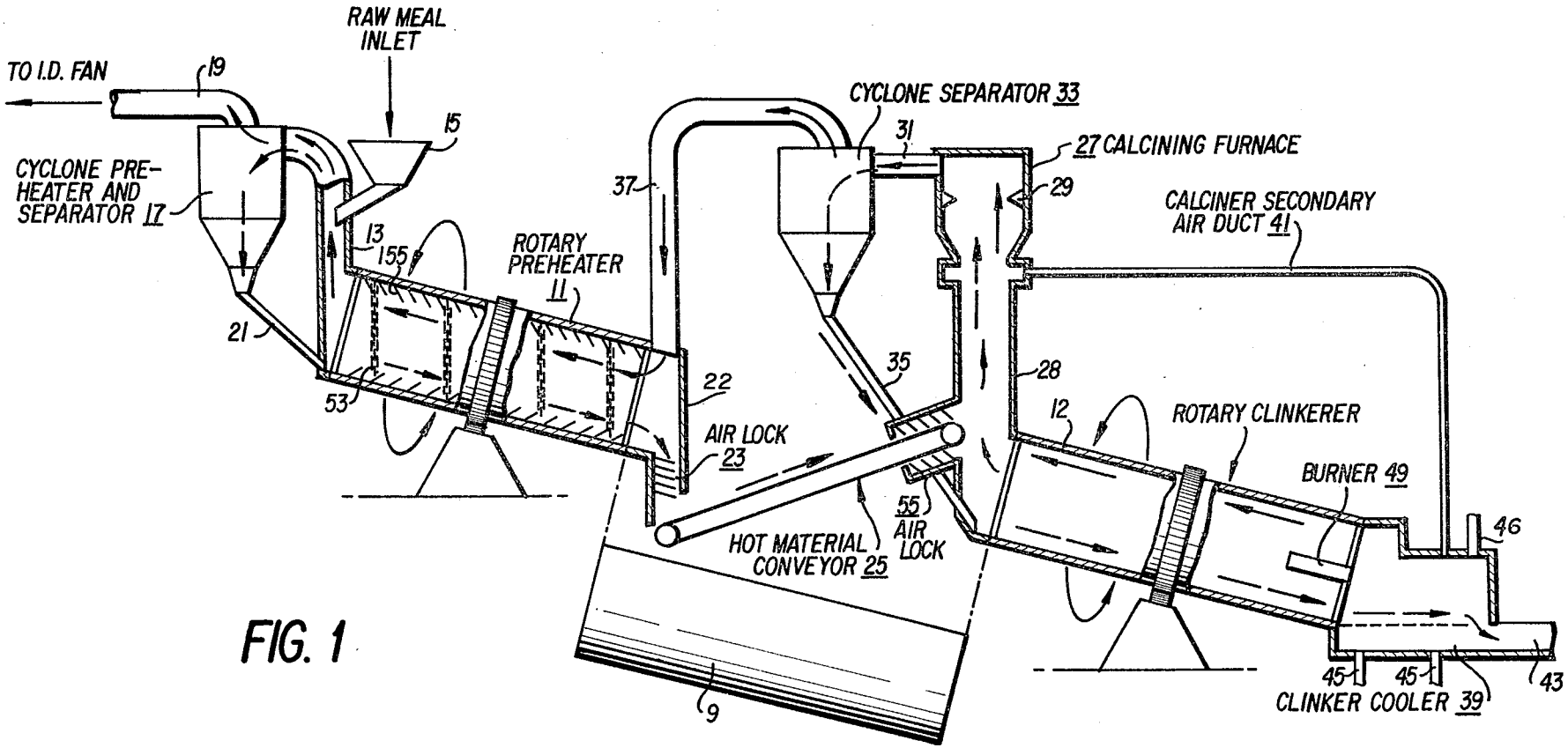
FIG. 1 is a diagrammatic view of a calcining/clinkering system of the invention after conversion of a long rotary kiln.

FIG. 1 illustrates the apparatus which results from the conversion of an existing long dry or wet process cement-making kiln using the conversion method of the invention. In the figures, the direction of feed material flow is represented by dotted arrows and the direction of gas flow is represented by solid arrows.

As illustrated in FIG. 1, a center section 9 of an existing long calcining/clinkering kiln is first cut and removed and thereafter a calcining furnace 27 such as that shown in U.S. Pat. No. 3,891,382, riser duct 28, cyclone material separator 33, material conveyor 25 and associated air locks 23 and 55 and duct work are arranged and connected between the two remaining separated kiln portions 11 and 12. The feed entering portion 11 of the segmented kiln forms a rotary preheater, while the other remaining kiln portion 12 forms a clinkering kiln. Either the existing or a new burner 49 is provided in the clinkering kiln 12. The furnace 27, riser duct 28, material separator 33 and material conveyor 25 are connected such that the material conveyor 25 receives preheated raw feed material from the rotary preheater 11 through a material discharge path including an air lock diagrammatically illustrated at 23 which forms part of a shroud 22 attached to the rotary preheating kiln 11. This material is conveyed to the riser duct 28 which flow connects the gas outlet of the clinkering kiln 12 with the material and gas inlet of the calcining furnace 27. Material is fed to the riser duct 28 through another air lock diagrammatically illustrated at 55 and is entrained by an upstream gas flow in the duct 28 produced by gas exiting from the clinkering kiln 12. The upstream gas flow in the duct 28 carries the preheated meal into the calcining furnace 27 where the raw meal is calcined while in suspension in the furnace 27. Burners 29 are positioned in the furnace 27 for adding sufficient heat to carry out the calcination of the raw meal. Typically, the temperature in the calcining furnace is maintained at between 800° and 900° C.

The gas and calcined material output of the calcining furnace is discharged via conduit 31 into the cyclone material separator 33. The cyclone separator 33 separates the gas and calcined material, providing them at appropriate outputs, respectively illustrated as conduits 37 and 35. The gas flow conduit 37 is connected to shroud 22 of the rotary preheater, providing the hot gas to preheat feed material entering the preheater 11. The calcined material conduit 35 is connected to the material input of the clinkering kiln 12 and feeds the calcined material into the clinkering kiln 12 where it is further heated by the hot gas flow therein produced by burner 49. The entering gas for clinkering kiln 12 is drawn from the clinker cooler 39 which has input cool gas conduits 45. The clinkered material output from clinkering kiln 12 is in turn fed to the clinker cooler 39 connected with clinkering kiln 12, the cooler having a cooled clinkered material output 43 and excess air outlet 46. Typically, the cooler 39 includes a grate system for supporting the clinker which allows cooling air to pass there-through. Thus, the clinkering kiln includes a material inlet at one end, a material outlet at its other end, a gas inlet at said other end and a gas outlet at said one end to thereby provide generally countercurrent flow between gas and material.

A secondary air duct 41 is also provided between the clinker cooler 39 and calcining furnace 27 to provide additional heated secondary air needed by burners 29 for combustion of the preheated meal.

The input device, as illustrated in FIG. 1, is a cyclone separator 17 which also functions as a preheater and which has a material output conduit 21 connected to the material input of the rotary preheater 11 and a heated gas input conduit 13 connected to the hot gas outlet of rotary preheater 11. A raw material inlet 15 is provided for feeding raw material through an air lock into the gas flow passing through conduit 13 which is carried by the hot gas flow into the preheating cyclone separator 17. A gas outlet conduit 19 interconnects separator 17 with a conventional induced draft fan (not shown) for drawing the heated gases through the system. Thus, the rotary preheater includes a material inlet at one end and a material outlet at its other end, and a gas inlet at said other end and a gas outlet at said one end to thereby achieve generally countercurrent flow between gas and material.

As shown, the conversion of an existing long dry or wet process cement making kiln to the apparatus disclosed in FIG. 1 is easily accomplished and retains major portions of the original kiln for preheating and clinkering, thereby reducing equipment and installation costs. In addition, the apparatus resulting from the conversion uses a rotary preheater 11 rather than a suspension type preheater and therefore has a reduced pressure drop in the preheating stage, an increased energy efficiency and a lowered equipment and installation cost.

Figure 2:
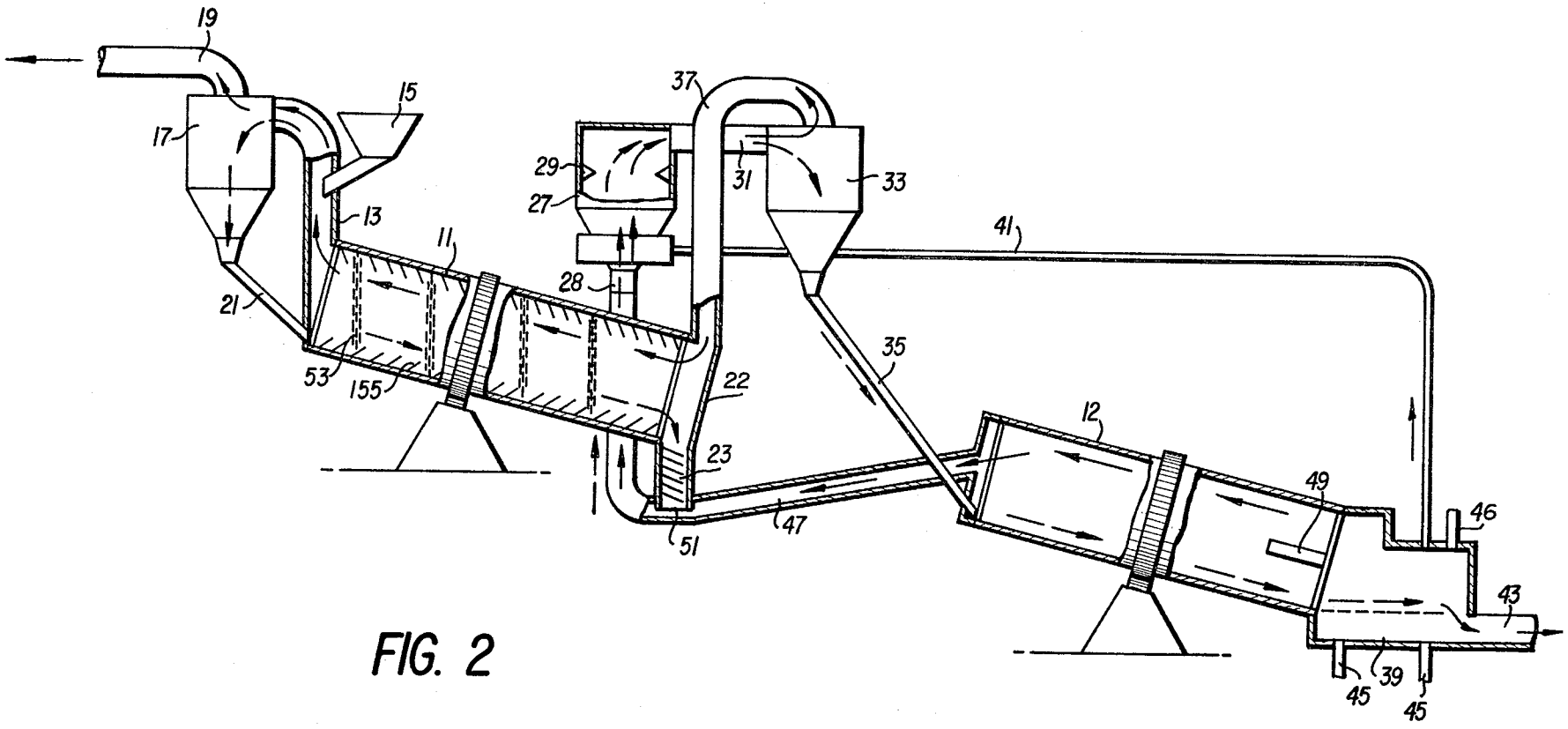
FIG. 2 is a diagrammatic view of a modification of the FIG. 1 system.

FIG. 2 illustrates a modification of the system of FIG. 1. In this modification, the hot material conveyor 25 illustrated in FIG. 1 is replaced by a pneumatic material conveying system consisting of a duct 47 coupling the gas output of clinkering kiln 12 to the heated gas input of clinkering furnace 27. The preheated material output of rotary preheater 11 still passes through an air lock 23 but is then dropped via conduit 51 into the gas stream of conduit 47 which conveys the preheated material into calcining furnace 27. A cement plant conversion using the pneumatic material transfer of FIG. 2 has the advantages of eliminating the mechanical conveyor which may be troublesome in operation because of the mechanical nature of the conveying operation. All other structures of the system illustrated in FIG. 1 are provided in the FIG. 2 embodiment.

As a further modification to the apparatus illustrated in FIGS. 1 and 2, the rotary preheater may be provided with chains 53 or material lifters 155, as diagrammatically illustrated in FIGS. 1 and 2 to facilitate heat transfer between the material and hot gases counterflowing in the rotary preheater. These heat exchanging aids are themselves known in the art and need not be further described.

From the foregoing, the operation of the converted system for manufacturing cement clinker should be apparent. Raw meal is supplied through an air lock into inlet 15 to duct 13 where it is entrained in gas being discharged from rotary preheater 11 and conveyed to cyclone separator 17. During this entrainment, the raw meal is partially preheated. The partially heated raw meal is discharged through conduit 21 into rotary preheater 11 and separated gas is discharged through conduit 19 to a high efficiency dust collector and atmosphere. As the preheater 11 is rotated about its own axis, the raw material tumbles downwardly through the inclined preheater to achieve intimate contact with the heat exchange elements 53 and 155 and hot gas flowing countercurrent thereto. The thus preheated raw material is discharged through air lock 23 either onto hot material conveyor 25 or into pneumatic conveying duct 47. The material is then conveyed to riser duct 28 and entrained in hot gases being discharged from clinkering kiln 12 and conveyed to calcining furnace 27.

In a known manner, fuel is supplied to calciner 27 through burners 29 and additional preheated combustion air is supplied to calciner 27 through duct 41. The raw meal is substantially completely calcined while in suspension in the calciner 27. The at least partially calcined raw material and spent combustion air are discharged from calciner 27 through outlet duct 31 to cyclone separator 33. Calcined material is discharged from cyclone 33 through duct 35 to the inlet of the clinkering kiln 12. Separated gas is conveyed from separator 33 by duct 37 to the shroud 22 of the preheater 11 to serve to preheat new raw material.

Once in the clinkering kiln 12, the calcined raw meal is subjected to higher temperatures in order to carry out the clinkering function in a known manner. As the kiln 12 rotates about its own axis, the material tumbles down the kiln until it is discharged as hot cement clinker into cooler 39. Ambient air is blown through the clinker to rapidly cool it and cooled clinker is discharged through outlet 43. The cooling air which is heated by the hot material serves as preheated combustion air in the kiln 12 and calciner 37.

Of course, when an existing long kiln is cut in the manner indicated above, the preheating section is provided with its own drive system.

With the conversion and use of the rotary preheater as described, a typical installation achieves a reduction in the preheater tower height by approximately 50 meters over a conversion using a multi-stage suspension preheater, with a corresponding saving in erection costs. In addition, with a multi-stage separator preheater system, the gas flow path typically passes through five vessels before reaching the clinkering kiln (four preheating cyclones plus the calcining furnace/-material separator). However, in the conversion illustrated using the rotary preheater and preferred cyclone preheater, the total number of vessels is reduced to three (one cyclone preheater, the rotary preheater, and the calcining furnace/material separator) with a corresponding reduction in pressure drop and power required to operate the system.

While the foregoing invention has been described with respect to specific embodiments, it is understood that these embodiments are merely exemplary. Consequently, the invention is to be construed as limited solely by the foregoing claims and not by the above description.

I claim:

1. A method for converting a long dry or wet process cement plant which includes an existing rotary kiln in which preheating, calcining and clinkering operations are carried out into a dry process cement making plant which includes a rotary preheater, stationary suspension calcining furnace and rotary clinkering kiln comprising the steps of:

cutting said existing rotary kiln and removing a central section thereof to provide a rotary preheater having a material inlet and outlet and a counter flowing hot gas inlet and outlet and a rotary clinkering kiln including a burner and having a material inlet and outlet and a counter flowing hot gas inlet and outlet;

connecting a stationary suspension calcining furnace having a burner to said rotary preheater and rotary clinkering kiln by coupling a hot gas inlet of said stationary suspension calcining furnace to the hot gas outlet of said rotary clinkering kiln and a material inlet of said stationary suspension calcining furnace to the material outlet of said rotary preheater; and connecting a gas-solid separator to said rotary preheater, said stationary suspension calcining furnace, and rotary clinkering kiln by coupling a hot gas and material inlet of said gas-solid separator to a hot gas and material outlet of said stationary suspension calcining furnace, a material outlet of said gas-solid separator to the material inlet of said rotary clinkering kiln, and a hot gas outlet of said gas-solid separator to the hot gas inlet of said rotary preheater.

2. A method as in claim 1, wherein the step of coupling the material outlet of said rotary preheater with the material inlet of said stationary suspension calcining furnace includes providing a hot material conveyor for feeding heated material from said rotary preheater to the material inlet of said stationary suspension calcining furnace.

3. A method as in claim 1, wherein the steps of coupling the material outlet of said rotary preheater with the material inlet of said stationary suspension calcining furnace and coupling the hot gas outlet of said rotary clinkering kiln with the hot gas inlet of said stationary suspension calcining furnace includes providing a hot gas conduit between the hot gas outlet of said rotary clinkering kiln and the hot gas inlet of said stationary suspension calcining furnace, providing a material discharge path into said conduit, and coupling the inlet of said material discharge path to the material outlet of said rotary preheater.

4. A method as in claim 1, further comprising the step of providing chains in said rotary preheater to facilitate heat transfer between the heated gas and material within said rotary preheater.

5. A method as in claim 1, further comprising the step of providing material lifters in said rotary preheater to facilitate heat transfer between the heated gas and material within said rotary preheater kiln.

6. A method as in claim 1, further comprising the step of connecting a cyclone separator preheater to the material inlet of said rotary preheater by coupling a material and gas inlet conduit of said cyclone separator preheater to the hot gas outlet of said rotary preheater, a material outlet of said cyclone separator preheater to the material inlet of said rotary preheater and an entering raw material passage to said material and gas inlet conduit.

* * * * *